US010146155B2

(12) United States Patent
Schulkes et al.

(10) Patent No.: US 10,146,155 B2
(45) Date of Patent: Dec. 4, 2018

(54) TONER BOTTLE CLOSURE AND TONER BOTTLE

(71) Applicant: Océ-Technologies B.V., Venlo (NL)

(72) Inventors: Joseph A. Schulkes, Venlo (NL); Johannes H. A. Dinnissen, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 7 days.

(21) Appl. No.: 15/365,565

(22) Filed: Nov. 30, 2016

(65) Prior Publication Data

US 2017/0153577 A1 Jun. 1, 2017

(30) Foreign Application Priority Data

Dec. 1, 2015 (EP) ..... 15197358

(51) Int. Cl.
*G03G 15/08* (2006.01)

(52) U.S. Cl.
CPC ..... *G03G 15/0877* (2013.01); *G03G 15/0867* (2013.01); *G03G 15/0886* (2013.01)

(58) Field of Classification Search
CPC .... G03G 2215/0678; G03G 15/0867–15/0872
See application file for complete search history.

(56) References Cited

U.S. PATENT DOCUMENTS 5,765,079 A * 6/1998 Yoshiki ..... G03G 15/0868 222/167
6,104,902 A * 8/2000 Meyer ..... G03G 15/0868 222/DIG. 1
6,421,518 B1 * 7/2002 Floyd ..... G03G 15/087 399/258
2005/0008399 A1 * 1/2005 Takuwa ..... G03G 15/0894 399/258
2006/0034642 A1 * 2/2006 Taguchi ..... G03G 15/0868 399/258
2007/0048029 A1 * 3/2007 Takuwa ..... G03G 15/0872 399/262

(Continued)

FOREIGN PATENT DOCUMENTS

EP 1 548 517 A1 6/2005
WO WO 2013/056986 A1 4/2013
WO WO 2013056986 A1 * 4/2013 ..... G03G 15/0894

*Primary Examiner* — Clayton E Laballe
*Assistant Examiner* — Ruifeng Pu
(74) *Attorney, Agent, or Firm* — Birch, Stewart, Kolasch & Birch, LLP

(57) ABSTRACT

A toner bottle closure includes a first closure member configured to be fixed to a toner bottle. The first closure member has an outlet opening for dispensing toner. A second closure member is movable relative to the first closure member along an axis between a closed position, in which the second closure member cooperates with the first closure member to close or seal the outlet opening, and an open position for dispensing the toner. The second closure member includes an impact damper, which projects at least partially in a direction parallel to the axis of movement. The impact damper is configured to deform plastically for damping a mechanical impact on the toner bottle closure. A rotation preventer is configured to prevent rotation of the second closure member around the axis of movement relative to the first closure member. A toner bottle including such a toner bottle cap is also disclosed.

16 Claims, 5 Drawing Sheets

(56) References Cited

U.S. PATENT DOCUMENTS

| | | | | |
|---|---|---|---|---|
| 2007/0147902 | A1* | 6/2007 | Taguchi | G03G 15/0863 399/262 |
| 2010/0209141 | A1* | 8/2010 | Ikado | G03G 21/1647 399/119 |
| 2011/0243579 | A1* | 10/2011 | Oshikawa | G03G 21/1875 399/12 |
| 2014/0227008 | A1* | 8/2014 | Janssen | G03G 15/087 399/258 |
| 2017/0153575 | A1* | 6/2017 | Schulkes | G03G 15/0867 |
| 2017/0153577 | A1* | 6/2017 | Schulkes | G03G 15/0877 |

* cited by examiner

TONER BOTTLE CLOSURE AND TONER BOTTLE

CROSS-REFERENCE TO RELATED APPLICATIONS

This application claims priority under 35 U.S.C. § 119 to Application No. 15197358.3, filed in Europe on Dec. 1, 2015, the entirety of which is expressly incorporated herein by reference.

BACKGROUND OF THE INVENTION

1. Field of the Invention

The present invention relates to a toner bottle closure, especially a closure for a toner re-fill bottle. The present invention also relates to a toner bottle that includes such a toner bottle closure.

2. Background of the Invention

In printing or copying systems, and especially in laser-based printing or copying systems, toner refill arrangements are used to refill a toner reservoir of a printer or copier. Toner is therefore filled from a toner bottle, which usually is configured as a re-fill bottle, into the toner reservoir.

Therefore, a refill mechanism and a toner bottle closure are provided that permit establishment of a flow communication between an interior of the toner bottle and the toner reservoir without permitting fine toner particles or powder (or alternatively toner liquid) to escape. Further, it should be avoided that toner powder (or toner liquid) remains on the external surfaces of the toner reservoir and the toner bottle when the refill process has been completed.

Another problem is to prevent the creation of toner crust or toner chips, which can form when toner particles or powder adheres to surfaces of the refill mechanism and may come into sliding engagement with one another such that frictional heat causes the toner powder to cake. Such toner crust or toner chips may disturb the toner development process in the printing or copying system if it/they enter the toner reservoir.

The published patent document WO 2013/056986 A1 describes a toner bottle cap of the general type mentioned above.

SUMMARY OF THE INVENTION

In view of the above, an object of the present invention is to provide a new and improved toner bottle closure and toner bottle, embodiments of which are set forth in the present claims.

According to one aspect, the present invention provides a toner bottle closure, especially a closure for a toner re-fill bottle. The toner bottle closure comprises a first closure member and a second closure member. The first closure member is configured to be fixed to a toner bottle and has an outlet opening for dispensing toner from the toner bottle. The second closure member is attached to the first closure member and is movable relative to the first closure member along an axis of movement between a closed position, where the second closure member cooperates with the first closure member to close or seal the outlet opening, e.g. against egress of toner, and an open position for dispensing the toner through the outlet opening. Furthermore, the second closure member comprises an impact damper, which projects at least partially in a direction parallel to the axis of movement. The impact damper is configured to deform plastically for damping a mechanical impact on the toner bottle closure.

In this way, the invention provides a toner bottle closure, which is configured for safe handling. If the toner bottle has previously been dropped or subject to impact, this may be recognized by a user via a visible deformation of the impact damper, which may render a previous or past mechanical impact on the toner bottle closure clearly visible. Typically, toner bottles that have been dropped once are rejected and/or excluded from use for safety reasons. According to the invention, a toner bottle that has been affected by a previous mechanical impact, and especially from being dropped, may be easily and unambiguously recognized and disposed of and/or excluded from use. Further, the impact damper provides for safely keeping the toner bottle closure closed, even if the toner bottle drops or falls and impacts the ground with the toner bottle closure. This is due to the fact that mechanical impact on the toner bottle closure is, at least partially, damped and/or absorbed via the impact damper. Axial movement of the second closure member relative to the first closure member towards the open position is thereby prevented. Therefore, even in the event of inadvertently dropping the toner bottle, leakage of toner can be averted. For the purposes of the present description, the term toner generally covers both toner particles or powder and toner liquid.

In a preferred embodiment, the impact damper is configured and arranged to absorb mechanical impact forces acting on the second closure member in the axial direction towards the closed position. Preferably, the impact damper may be further configured to prevent a resilient return or spring-back reaction of the second closure member in the event of a mechanical impact. In particular, a resilient return or spring-back into the open position can be substantially avoided or prevented. In this respect, especially if a toner bottle equipped with the toner bottle closure falls and hits the ground with the toner bottle closure, a spring-back reaction into the open position may be prevented.

In a preferred embodiment, the impact damper projects from the second closure member towards the first closure member for engagement therewith in the closed position. Preferably, the impact damper projects towards the first closure member at an oblique angle. Therefore, advantageously, the impact damper can be plastically deformed only to the extent necessary for damping the impact. In particular, deformation takes place with a minimized or comparably small elastic and a maximal or large plastic deformation. Furthermore, the oblique angle may predetermine the manner or type of plastic deformation, which allows a suitable design of all components of the toner bottle closure configured for accommodation of that predetermined plastic deformation.

In a preferred embodiment, the impact damper includes a predetermined deformable portion for damping mechanical impact by means of a predefined plastic deformation. In this way, a clear visualization of a former mechanical impact is provided. A user may therefore recognize a former impact of the toner bottle by the feature of the plastically deformed deformable portion. In this way, the invention provides for improved safety in use of toner bottles, since undesired use of toner bottles that have been dropped may be avoided.

The deformable portion may comprise, or be formed as, a compressible member. In particular, the deformable portion may be formed compressible in a predefined direction thereof, which direction is preferably parallel to the axis of movement of the second closure member. The compressible member deforms plastically when compressed. It may be provided alternatively or additionally to other kinds of deformable portions.

In a preferred embodiment, the deformable portion comprises, or may be formed as, a flap or a lip. This flap or lip preferably extends along an outer edge or rim of the second closure member. The deformable portion is advantageously positioned on a periphery or outer side of the toner bottle closure and where it may be easily seen and/or checked. By virtue of the preferably straight and defined form of a flap or lip, a deformation may be easily recognized.

In a preferred embodiment, the flap or lip of the impact damper is fixed to the second closure member along one edge region thereof and projects towards a free edge region thereof which, in turn, contacts or engages with the first closure member in the closed position. The impact damper may thus be designed or configured to deform plastically through bending of the flap or lip about an axis substantially parallel to the fixed edge region. Any such bending is desirably easily recognizable from external observation of the closure.

According to an embodiment of the invention, the second closure member includes a force transfer element that projects from the second closure member in direction away from the first closure member. The force transfer element is configured to transfer a load of a mechanical impact directly to the impact damper. Preferably, the force transfer element projects beyond any part of the first closure member or any other part of the second closure member. Therefore, if the toner bottle falls and hits the ground with the toner bottle closure, an impact is located directly at the force transfer element. The force or load of the impact may thus be directly transferred to the impact damper.

According to a further embodiment, the force transfer element comprises a lip. The force transfer element may also be formed as a lip. The lip preferably extends parallel to the impact damper.

According to another aspect of the invention, the present invention provides a toner bottle closure, especially a closure for a toner re-fill bottle. The closure comprises a first closure member and a second closure member. The first closure member is configured to be fixed to a toner bottle and has an outlet opening for dispensing toner from the toner bottle. The second closure member is attached to the first closure member and is movable relative to the first closure member along an axis of movement between a closed position, in which the second closure member cooperates with the first closure member to close or seal the outlet opening, especially against egress of toner, and an open position for dispensing the toner through the outlet opening. Furthermore, a rotation prevention mechanism or rotation preventer is configured to prevent rotation of the second closure member about the axis of movement relative to the first closure member.

In this way, the invention further provides a toner bottle closure that is configured to prevent the formation of toner crust or chips. Since, according to an embodiment of the invention, a relative rotational sliding between surfaces or walls of the first and second closure members can be prevented, and rotational friction or rubbing between such surfaces or walls of the first and second closure members can be substantially avoided. Thus, the toner cannot be exposed to heat caused by rotational friction, which results in the prevention of toner powder caking.

In a preferred embodiment, the rotation preventer comprises at least one guide, which allows movement of the second closure member relative to the first closure member in a direction parallel to the axis of movement. In a preferred embodiment, the guide is formed separate from axially sliding walls of the first and second closure member, which form and close the outlet opening. However, in a further embodiment, the guide can also be formed integral with the sliding walls.

In a preferred embodiment, the rotation preventer includes a stop member for delimiting an extent of axial movement of the second closure member relative to the first closure member in the open position. This effectively prevents complete separation of the first and second closure members. Therefore, a high degree of safety of use is provided.

In a preferred embodiment, the at least one guide is formed integrally with the stop member. In the case of multiple guides, preferably each guide is provided or formed with a stop member. This way, a maximum open position can be defined by the stop member(s).

In a preferred embodiment, the at least one guide comprises a guide pin or guide peg, which projects in the axial direction from the second closure member in a direction towards the first closure member. Further, the at least one guide includes at least one complementary guide opening in the first closure member, through which the guide pin or peg extends. This way, each guide may be realized in a simple manner that is easy to manufacture.

In a preferred embodiment, the stop member is formed as an engagement device, especially an engagement hook, formed at an end region of the guide pin or guide peg for engaging an edge or rim of the guide opening. In this way, a simple and tool-free assembly of the toner bottle closure may be provided. For assembly of the closure, the engagement device of each guide pin or peg may be inserted into the respective guide opening of the first closure member and preferably snap-fitted into engagement therewith.

According to another aspect, the present invention provides a toner bottle having a toner bottle closure according to any one of the embodiments described above.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
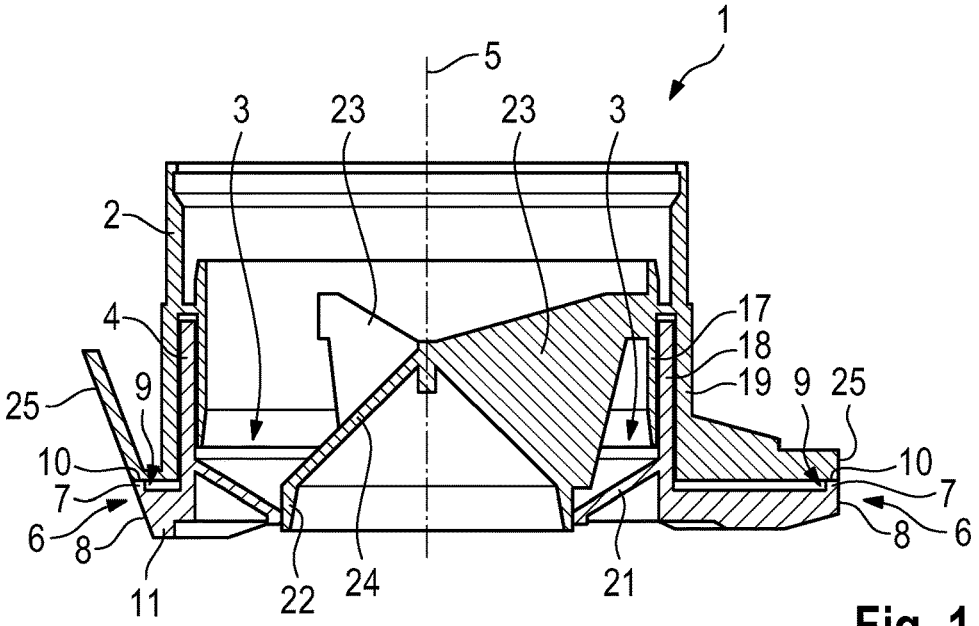
FIG. 1 is a schematic front cross-sectional view of a toner bottle closure according to an embodiment of the invention in a closed position.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

DETAILED DESCRIPTION OF THE PREFERRED EMBODIMENTS

The present invention will now be described with reference to the accompanying drawings, wherein the same or similar elements are identified with the same reference numeral.

With reference firstly to FIG. 1 of the drawings, a cross-sectional view of a toner bottle closure is illustrated schematically in a closed position. The toner bottle closure 1 includes a first closure member 2 and a second closure member 4. The first closure member 2 is configured to be fixed to a toner bottle (not shown in FIG. 1) and defines an outlet opening 3 for dispensing toner from the toner bottle. The second closure member 4 is attached to the first closure member 2 and is movable relative to the first closure member 2 along an axis 5 between the closed position shown and an open position. In the closed position depicted in FIG. 1, the second closure member 4 cooperates with the first closure member 2 to close the outlet opening 3 against egress of toner.

Furthermore, the second closure member 4 comprises impact damper 6, which projects in a direction parallel to the axis 5 of movement. The impact damper 6 is configured to deform plastically for damping a mechanical impact on the toner bottle closure 1. It is therefore configured and arranged to absorb mechanical impact forces acting on the second closure member 4 in the axial direction 5 towards the closed position. The impact damper 6 acts to prevent a resilient spring-back reaction of the second closure member 4 into the open position in the event of a mechanical impact. In particular, if a toner bottle equipped with the toner bottle closure 1 falls and hits the ground with the toner bottle closure 1, the impact damper 6 acts to prevent or inhibit the second closure member 4 from springing into the open position, thereby acting to keep the opening 3 safely closed.

Figure 6:
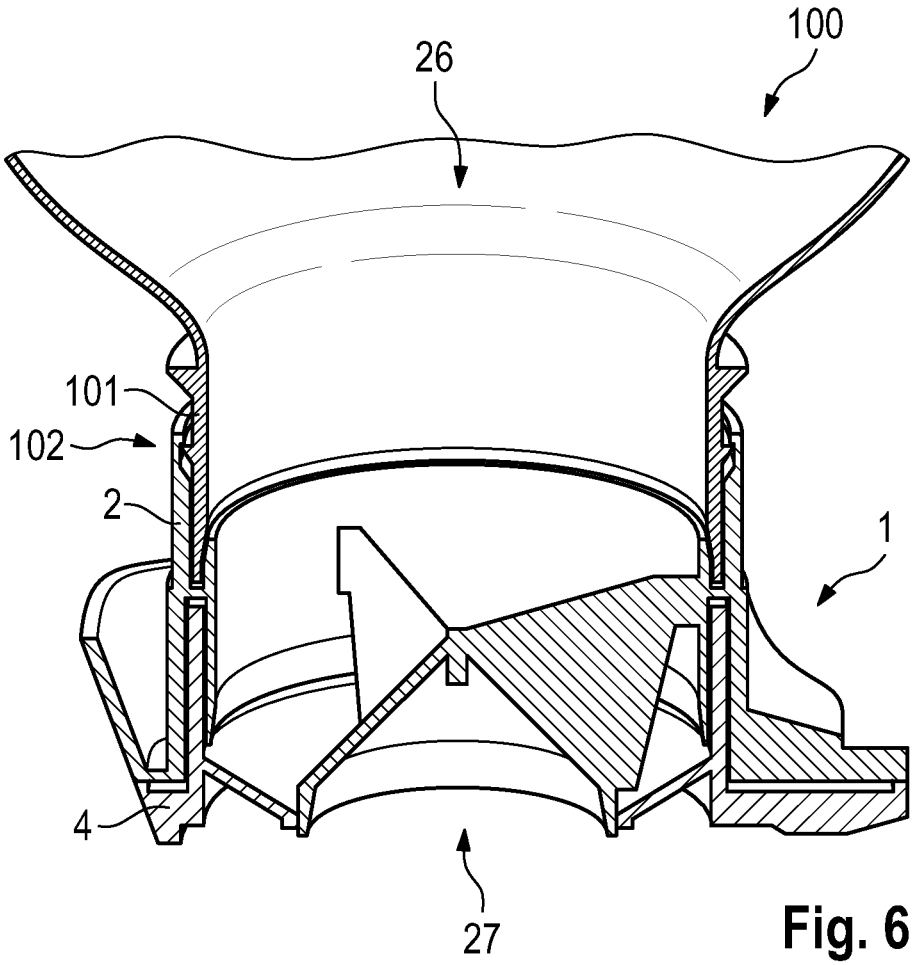
FIG. 6 is a schematic partial perspective cross-sectional view of a toner bottle with a toner bottle closure according to an embodiment of the invention.

As shown in FIG. 6, the first closure member 2 is configured to be fixed at a bottle neck 101 of a toner re-fill bottle 100 and is therefore formed as a tubular body. The second closure member 4 is formed as a tubular sleeve with a peripheral wall 18 that is configured for sliding engagement with an internal surface of a peripheral wall 19 of the first closure member 2. In the embodiment shown, the first closure member 2 is internally formed with a skirt 17 that is in sliding engagement with the internal surface of the peripheral wall 18 of the second closure member 4.

Figure 2:
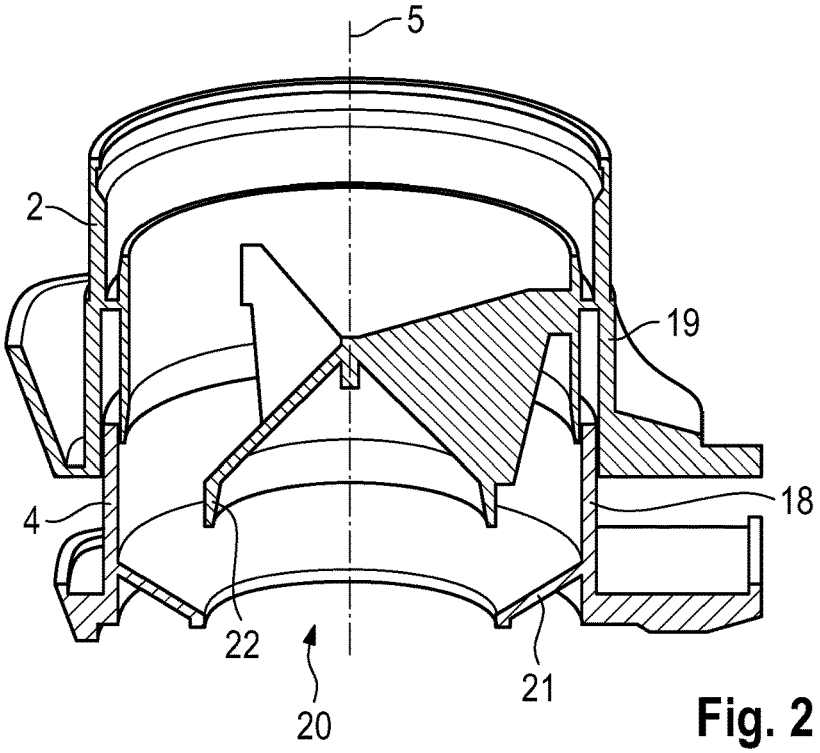
FIG. 2 is a schematic perspective cross-sectional view of the toner bottle closure of FIG. 1 in an open position.

With reference to FIG. 2 of the drawings, a cross-sectional view of the toner bottle closure is illustrated schematically in an open position. In the open position, toner can be dispensed through the outlet opening 3. Furthermore, the second closure member 4 defines a flow passage 20 for the toner powder. In the open position of FIG. 2, the outlet opening 3 and the flow passage 20 are coaxial and are connected to one another, so that toner powder from the bottle may flow there-through in an outflow direction from the first closure member 2 to the second closure member 4. At its lower end, the second closure member 4 has a narrowed funnel-shaped wall part 21 that restricts the cross-section of the flow passage 20.

In the closed position shown in FIG. 1, the flow passage 20 is closed or sealed by a cylindrical central member 22 that is disposed centrally in the outlet opening 3 and is fixed in position by radial spokes 23 connecting a wall of the central member 22 to the peripheral wall 19 of the first closure member 2. The radial spokes 22 divide the outlet opening 3 into a plurality of sector-shaped openings through which the toner, in particular toner particles or powder, may pass.

Furthermore, the cylindrical central member has a cone shaped upper region 24. The cone shape of the upper region 24 closes the cylindrical shape in a direction towards the toner bottle 100 and provides for a smooth and constant flow and for equal distribution of toner to all sectors of the outlet opening 3. In the condition shown in FIG. 1, which is the closed position of the closure 1, the bottom end of the central member 22 is flush with the flow passage 20 and is precisely fitted in the flow passage 20, so that no toner may pass there-through.

The second closure member 4 includes a force transfer element 11, which projects from the second closure member in direction generally away from the first closure member 2. The force transfer element 11 is configured to transfer a force or load of a mechanical impact directly to the impact damper 6. Thus, the force transfer element 11 projects in the axial direction beyond any part of the first closure member 2 or any other part of second closure member 4, and especially beyond the flow passage 20 and cylindrical central member 22. In the embodiment shown, the force transfer element 11 is formed as a projecting rim of the closure member 4, which extends generally parallel to the impact damper 6.

In order to open the toner bottle closure 1, the second closure member 4 is moved axially downwardly relative to the first closure member 2, as shown in FIG. 2. As a result, the central member 22 is withdrawn from the flow passage 20, so that toner may flow out through the outlet opening 3 and the flow passage 20.

During the axial downward movement of the second closure member 4 relative to the first closure member 2, the peripheral wall 18 of the second closure member 4 slides along the internal surface of the outer peripheral wall 19 of the first closure member 2. However, because the internal surface of the peripheral wall 19 of the first closure member 2 was covered by the peripheral wall 18 of the second closure member 4 and/or by the skirt 17, no toner, particularly no toner powder, can adhere to that wall. Toner, and particularly toner powder, may adhere only to the internal surface of the lower part of the peripheral wall 18 of the second closure member 4 which is not covered by the skirt 20.

During opening movement of the second closure member 4, this member moves axially downwards, i.e. in the outflow direction of the toner, so that an increasingly larger portion of the internal surface of the peripheral wall 18 becomes exposed to the toner. However, provided a movement of the second closure member 4 is not reversed, none of these surface areas of the second closure member 4 will come into sliding engagement with a part of the first closure member 2 again. As a result, the toner may smoothly flow out of the bottle without being exposed to any frictional heat. In this way, the especially fine toner powder is not caused to cake or to form larger solid chips. Thus, when a toner bottle with the closure 1 is placed on top of a refill opening of a toner reservoir of a copier or printer device, the toner, and particularly toner powder, exiting from the flow passage 20 will not contain any chips that could deteriorate the printing properties of the toner.

When the second closure member 2 is moved axially upwards again to the closed position, any remnants of toner that stick to the internal wall of the second closure member 2 may be stripped-off by the skirt 17 and fall down towards the funnel shaped wall part 21. However, as the inclination of this wall part 21 is relatively small, the toner removed from the peripheral wall (and any chips that may possibly be formed) will not reach the flow passage 20 before it is closed again by the central member 22. It will further be noted that the wall part 21 is relatively thin, so that the edge surface of the flow passage 20 has only a very small surface area to which only very minute amounts of toner may adhere. Consequently, the amount of toner that may exit the closure 1 when it is closed again is extremely small. In a similar manner, the central member 22 is configured as a thin-walled hollow cylinder (closed conically at the top end), so that practically no toner powder will adhere to the bottom end of the central member 22 either.

Figure 3A:
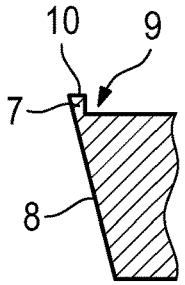
FIG. 3A is a schematic cross-sectional view of part of the toner bottle closure showing an impact damper in a non-deformed state.

Referring now to FIG. 3A of the drawings, a schematic cross-sectional view of the impact damper 6 and particularly a deformable portion 7 thereof is shown. The impact damper 6 comprises the deformable portion 7 for damping mechanical impact by means of a predefined plastic deformation. The deformable portion 7 is formed as an elongate lip. The lip 7 extends along an outer periphery 8 of the second closure member 4 and is fixed thereto along an edge region 9 of the lip 7 and projects to a free edge region 10. The free edge region 10 of the lip 7 engages with the first closure member 2, particularly in a region of an outer periphery 25 thereof, in the closed position as shown in FIG. 1.

Figure 3B:
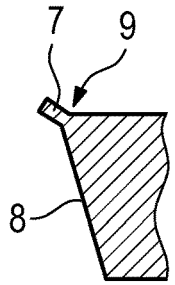
FIG. 3B is a schematic cross-sectional view of part of the toner bottle closure showing the impact damper in a plastically deformed state.

FIG. 3B schematically illustrates the deformable portion 7 in a plastically deformed state. The deformable portion 7 is configured to deform plastically through bending of the lip 7 about an axis substantially parallel to the fixed edge region 9 in case of a mechanical impact, as illustrated in FIG. 3B.

Figure 4:
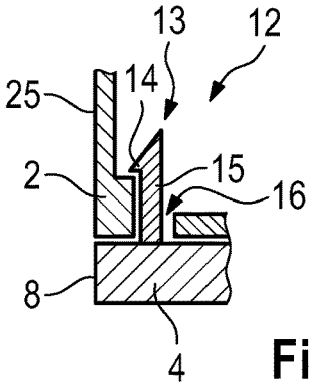
FIG. 4 is a schematic cross-sectional view of part of the toner bottle closure showing a guide.

Referring now to FIG. 4 of the drawings, a schematic cross-sectional view of a guide 13 is illustrated. The guide 13 forms part of a rotation preventer 12 for preventing rotation of the second closure member 4 about the movement axis 5 relative to the first closure member 2. The guide 13 is thus configured or designed to allow only movement of the second closure member 4 relative to the first closure member 2 in a direction parallel to the axis 5. This way, rotation of the second closure member 4 relative to the first closure member 2 is prevented, and thereby also rotational friction. The guide 13 includes a pin or peg element 15, which projects from the second closure member 4 in the axial direction towards the first closure member 2. Furthermore, the guide 13 includes a guide opening 16 in the first closure member 2, through which the pin or peg element 15 extends. The pin or peg element 15 of the guide 13 includes a stop member 14 configured as an engagement hook formed integrally at an end region thereof for engaging a rim or edge of the guide opening 16, through which the pin or peg element 15 extends. The engagement hook therefore limits or defines an extent of the axial movement of the second closure member 4 relative to the first closure member 2 in the open position of FIG. 2.

Figure 5:
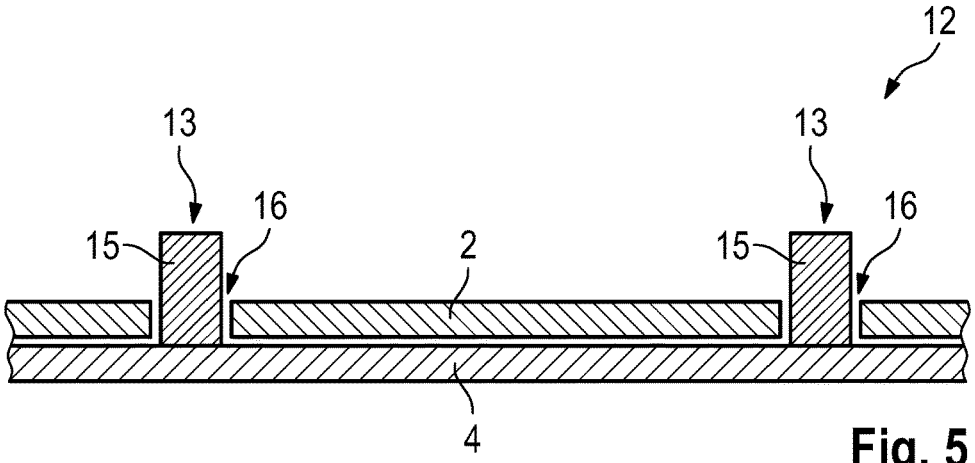
FIG. 5 is a schematic lengthwise cross-sectional view of part of the toner bottle closure showing two parallel guides.

Referring to FIG. 5 of the drawings, a lengthwise schematic cross-sectional view of two parallel guides 13 is illustrated. The shown cross-sectional plane is parallel to the outer periphery 8 of the second closure member 4, which outer periphery 8 has a four sided shape, preferably with two long sides and two shorter sides as well as two rounded corners and two sharp corners. Further, the cross-sectional plane is also parallel to the outer periphery 25 of the first closure member 2, which has a shape that continues the shape of the outer periphery 8 of the second closure member 4. The cross-sectional plane therefore may cut or be tangent to peripheral walls 18 and 19 (not shown in FIG. 5). A pair of guides 13 as depicted in FIG. 5 may be provided on both long sides of the outer peripheries 8, 25. Thus, a total number of four guides 13 may be provided. Preferably, one guide 13 is positioned in each corner of the outer periphery 8, 25.

With reference to FIG. 6 of the drawings, a schematic partial cross-sectional view of a toner bottle 100 is illustrated. The toner bottle 100 includes a bottle neck 101 shown in an inverted state with the bottle neck 101 facing downward. It will be understood that the term "toner bottle" as used here designates any type of vessel or container that is capable of accommodating powdery or liquid toner.

The toner bottle 100 is closed by the closure 1. Thus, the first closure member 2 is secured at the bottle neck 101 of the toner bottle 10 with an engaging flange connection 102. Accordingly, the closure has an outer region 27, which is isolated from toner, and an inner region 26, which is in contact with toner. Should the toner bottle 100 fall and hit the ground at the toner bottle closure 1, an impact will be imparted directly to the force transfer element 11. A load or force of the impact will thus be directly transferred to the impact damper 6, such that a predefined flux of forces is provided.

Figure 7:
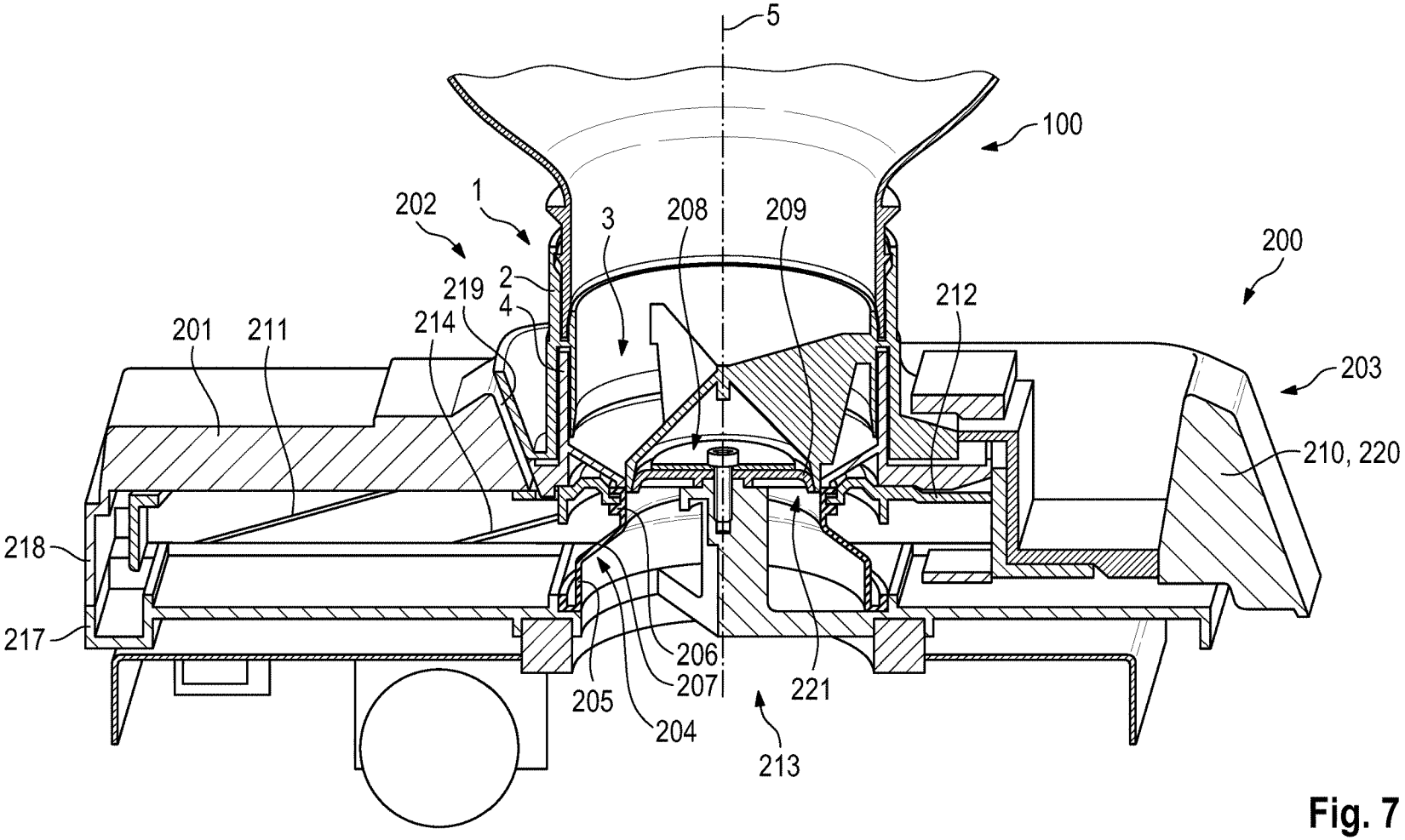
FIG. 7 is a schematic cross-sectional view of a refill adapter and toner bottle closure in a closed position according to an embodiment of the invention.

Referring to FIG. 7 of the drawings, a refill adapter 200 and a toner bottle 100 with a closure 1 are illustrated schematically in a closed position. The toner bottle closure 1 is provided with the construction according to FIGS. 1 to 6.

The refill adapter 200 is positioned at a reservoir opening 213 of a toner reservoir (not shown). The refill adapter comprises a base 201 having an insertion area 202 for receiving the closure 1 inserted therein. An opening mechanism 203 is provided for opening the closure 1. The base comprises a base plate 217 and a socket plate 218 forming an upper surface of the refill adapter 200 including part of the insertion area 202, which is formed in a socket-like manner. The shape of the insertion area 202 corresponds to the outer shape of the closure 1.

To refill the toner reservoir, the toner bottle 100 is inverted and the closure 1 of the bottle is inserted into the insertion area 202 so that the toner bottle 100 with the closure 1 may be coupled to the refill adapter 200. The opening mechanism 203 is configured to hold the first closure member 2 of the closure 1 and to move the second closure member 4 of the closure 1 in the axial direction relative to the first closure member 2.

For holding the first closure member 2, the refill adapter 200 comprises a support element 208 provided on the base 201. The support element 208 is fixed to the base plate 217 and is located centrally within the insertion area 201. The support element 208 is formed with a round or disc-shaped flange configured to engage the central member 22 and thereby to support the first closure member 2 when, as shown in FIG. 7, the closure 1 is inserted into the insertion area 202. Additional to the support element 208, the socket plate 218 supports the first closure member 2 with a socket-shaped surface 219 forming a rim of the insertion area 202. When the opening mechanism 203 moves the second closure member 4 along the axis 5 into the open position, toner can be dispensed from the toner bottle 100 through the outlet opening 3 into the toner reservoir.

Figure 8:
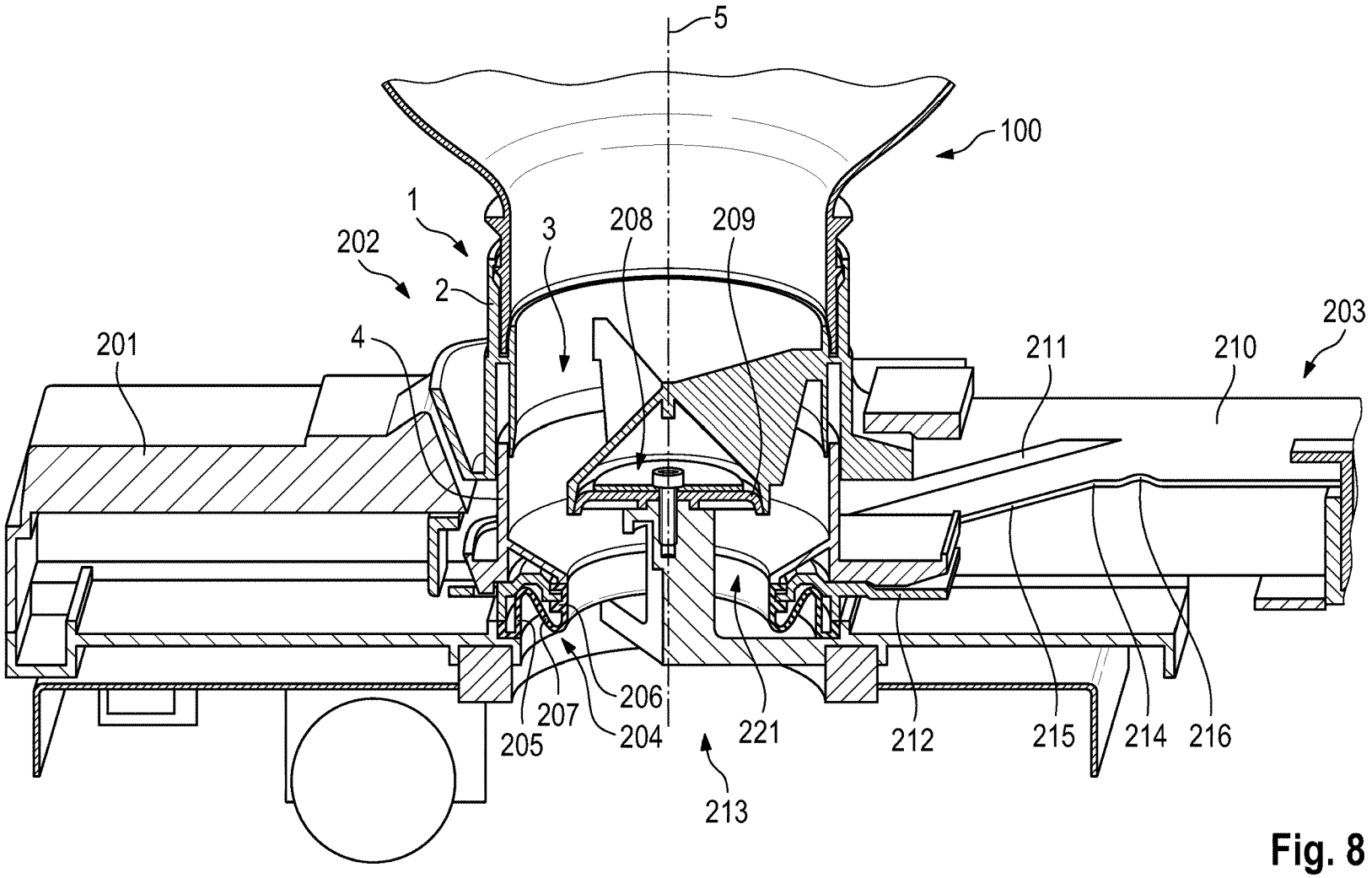
FIG. 8 is a schematic cross-sectional view of a refill adapter and toner bottle closure in an open position according to an embodiment.

With reference now to FIG. 8 of the drawings, the refill adapter 200 and the toner bottle closure 1 are illustrated schematically in the open position. The refill adapter 200 includes a sealing device 204 for isolating the outer region 27 of the closure from the inner region 26 of the closure, which is in contact with toner, in the open position. The sealing device 204 comprises a flexible sealing membrane, which can be seen to have three parts. In particular, the flexible sealing membrane includes a first sealing part 205, which is fixed to the base plate 217 of the base 201, and a second sealing part 206, which engages the funnel-shaped wall part 21 around the flow passage 20 and which is movable relative to the first sealing part 205. The second sealing part 206 is thus configured to move with the second closure member 4 along the axis 5 and thereby to remain in contact the second closure member 4. The flexible sealing membrane further comprises a third sealing part 207, which interconnects the first sealing part 205 and the second sealing part 206. It is desirably configured to impart a resilient bias to the second sealing part 206 to press and seal against the second closure member 4. The third sealing part 207 may therefore be provided in the form of an annular elastic or resilient spring, having a frusto-conical shape extending axially with an oblique angle between the first sealing part 205 and the second sealing part 206. The first and second sealing parts 205, 206 are also typically annular. The first sealing part 205 has a larger diameter than the second sealing part 206 and the third sealing part 207. Thus, in the closed state of the closure 1, when the third sealing part 207 is extended, as shown in FIG. 7, the sealing device 204 has a shape of an outwardly tapering or widening tube.

To move the second closure member 4, the opening mechanism 203 comprises a slider 210 disposed in the base 201. The slider 210 is movable in a direction that is approximately normal to the movement axis 5 of the second closure member 4. The slider 210 can be slid between a first position, in which it is retracted into the base 201, and a second position, in which it is extended out of the base 201. The slider 210 includes a translation mechanism 211 configured to translate the sliding movement of the slider 210 into axial movement of the second closure member 4. The translation mechanism 211 includes guide grooves that are engaged by cams or followers (not shown) that project outwardly from a base part or outer periphery 8 of the second closure member 4. The cams or followers travel in the guide grooves during sliding movement thereof, so that the grooves translate the movement of the slider 210 into an axial movement of the second closure member 4 between the first retracted position and the second extended position. The slider 210 also entrains the second closure member 4 by means of the grooves 211, when the slider is moved from the first position into the second position. As a result, the closure 1 inserted in the insertion area 202 can be manipulated between the closed position and the open position by extending and retracting the slider 210.

The slider 210 forms the only laterally moving component of the refill adapter 200. The sealing device 205 in cooperation with the closure 1 isolates the area of the slider 210 from the inner region 26 of the closure 1. As a result, toner cannot be trapped between the slider and the base. The slider 210 typically further comprises a handle 220 to allow convenient manual activation of the slider 210. Additionally, the slider 210 may include a control mechanism 214 configured to control the axial movement of a platform 212.

The platform 212 is disposed in the base 201 and is movable along the axis 5. The platform 212 is configured to close the reservoir opening 213 in the non-operating state and/or when (in the operating state) the closure is in the closed position. The platform 212 may therefore form a rigid closing element for the reservoir opening 213. In this regard, the platform 212 may have a round or circular recess 221 in which the second sealing part 206 is accommodated and attached to the platform 212. The round recess therefore defines the shape of the second sealing part 206. To close the reservoir opening 213, the round recess 221 of the platform 212 cooperates with round support element 208, with the second sealing part 206 there-between. The sealing device 205 and the support element 208 are therefore configured to fit together for closing the reservoir opening 213 of the toner reservoir in a sealed manner.

In the non-operating state of the refill adapter 200, when the insertion area 202 is free of any closure 1, a closed surface is formed by the platform 212, the support element 208 and the socket plate 218. In the operating state of the adapter 200, when a closure 1 is in the insertion area 202, the platform 212 cooperates with the second closure member 4 so that the second sealing part 206 contacts the second closure member 4. The platform 212 ensures that the form and position of the second sealing part 206 fits to the support element 208 in the non-operating state and to the second closure member 4 in the operating state. Axial movement of the platform 212 and the second closure member 4 are both controlled by means of the slider 210 and therefore synchronized.

A control mechanism 214 of the slider 210 is also formed by guide grooves, which are engaged by cams or followers (not shown) that project outwardly from the platform 212. The control mechanism 214 thus also comprises a translation control section 215 for controlling translation of the sliding movement of the slider 210 into an axial movement of the platform by means of an incline of the guide grooves. Furthermore, the control mechanism 214 comprises a lock control section 216 for locking the platform 212 in a position in which it closes the insertion area 202, in particular in the non-operating state. The locking mechanism 216 is formed by a wave of the guide grooves, which elastically compresses the cams and thus provides for increased frictional resistance to be overcome by the slider 210 in order to move.

Unwanted movement of the slider 210 and the platform 212 is therefore advantageously prevented.

The support element 208 comprises a flexible fitting part 209 at an outer edge thereof. The flexible fitting part 209 has multiple different functions in the different states of the refill adapter 200: In the non-operating state or when (in the operating state) the closure is in the closed position, the flexible fitting part 209 is designed or configured for contacting the second sealing part 206 for sealing the reservoir opening 213. When, in the operating state, the closure 1 is in the open position, the flexible fitting part 209 is configured for contacting the end portion of the central member 22 of the first closure member 2 for isolating the central member 22 from the inner region 26 of the closure 1. This way, the central member 22 is kept clean from toner.

As a result, all parts of the closure 1 that could be accessible for a user when the closure 1 is removed from the insertion area 202 are isolated from the inner region 26 in contact with toner. This isolation is provided in the open position or in any intermediate position of the closure 1. Therefore, a refill process can be conducted by a user without any contact with toner, even if the outer region 27 of the closure 1 is touched after release of the closure 1 from the insertion area 202.

For releasing the closure 1 from the insertion area 202 when the refill process has been completed, the slider 210 is retracted back into the base (towards the left side in FIG. 8) so that the second closure member 4, the second sealing part 206 and the platform 212 are moved back into the closed position as shown in FIG. 7. The closure 1 and the reservoir opening 213 are thereby closed. None of the parts of the refill adapter 200 in contact with toner is exposed to frictional forces until the second sealing part 206 contacts the support element 208 and the reservoir opening 213 is closed, as only parts that are not in contact with toner are in sliding or moving contact. Thus, no toner crusting or caking occurs due to frictional forces when the opening mechanism 203 of the refill adapter 200 is manipulated. Finally, after refilling the reservoir, the toner bottle 100 with the closure 1 may be detached from the insertion area 202 and disposed of or recycled.

Although specific embodiments of the invention are illustrated and described herein, it will be appreciated by those of ordinary skill in the art that a variety of alternate and/or equivalent implementations exist.

In the embodiment that has been described here, for example, the second closure member 4 is lowered in order to open the outlet opening 3. Of course, a modified embodiment is also possible wherein, rather than descending the second closure member 4, the slider 210 controls a lift movement of the first closure member 2 and the toner bottle 100. In this case, for example, the support element 208 and the first closure member could be moved axially upwards by the slider 210 into an open position. Furthermore, a combination of both, a lowering of the second closure member 4 and lifting of the first closure member 2, is possible.

It may also be understood, that the bottle closure as disclosed and claimed in the present application may also be suitable for being used in combination with bottles containing other powder like substances or liquids, such as ink compositions.

It will be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

1 toner bottle closure
2 first closure member
3 outlet opening
4 second closure member
5 axis
6 impact damper
7 lip
8 outer periphery
9 fixed edge region
10 free edge region
11 force transfer element
12 rotation preventer
13 guide
14 stop member
15 pin or peg element
16 guide opening
17 skirt
18 peripheral wall
19 peripheral wall
20 flow passage
21 wall part
22 central member
23 spoke
24 top
25 outer periphery
26 inner region
27 outer region
100 toner bottle
101 bottle neck
102 flange connection
200 refill adapter
201 base
202 insertion area
203 opening mechanism
204 sealing device
205 first sealing part
206 second sealing part
207 third sealing part
208 support element
209 fitting part
210 slider
211 translation mechanism

212 platform
213 reservoir opening
214 control mechanism
215 translation control section
216 lock control section
217 base plate
218 socket plate
219 socket-shaped surface
220 handle
221 recess The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner bottle closure comprising:

a first closure member configured to be fixed to a toner bottle, the first closure member having an outlet opening for dispensing toner from the toner bottle; and a second closure member attached to the first closure member and movable relative to the first closure member along an axis of movement between a closed position, in which the second closure member cooperates with the first closure member to close or seal the outlet opening, and an open position for dispensing the toner through the outlet opening, wherein the second closure member comprises an impact damper projecting at least partially in a direction parallel to the axis of movement, and wherein the impact damper is configured to deform plastically for damping a mechanical impact on the toner bottle closure.

2. The toner bottle closure according to claim 1, wherein the impact damper is configured and arranged to absorb mechanical impact forces acting on the second closure member in the direction parallel to the axis of movement towards the closed position, and wherein the impact damper is configured to prevent a resilient spring-back reaction of the second closure member into the open position in the event of a mechanical impact.

3. The toner bottle closure according to claim 1, wherein the impact damper projects from the second closure member towards the first closure member for engagement therewith in the closed position.

4. The toner bottle closure according to claim 3, wherein the impact damper projects towards the first closure member at an oblique angle.

5. The toner bottle closure according to claim 1, wherein the impact damper comprises a predetermined deformable portion configured to damp mechanical impact by means of a predefined plastic deformation.

6. The toner bottle closure according to claim 5, wherein the deformable portion comprises, or is formed as, a flap or lip.

7. The toner bottle according to claim 6, wherein said flap or lip extends along an outer edge or rim of the second closure member.

8. The toner bottle closure according to claim 7, wherein the flap or lip of the impact damper projects from one edge region, said one edge region being fixed on the second closure member to a free edge region that engages with the first closure member in the closed position, and wherein the impact damper is configured to deform plastically through rotation of the flap or lip about an axis substantially parallel to the fixed edge region.

9. The toner bottle closure according to claim 1, wherein the second closure member comprises a force transfer element projecting from the second closure member in a direction away from the first closure member, and wherein the force transfer element is configured to transfer a load of a mechanical impact directly to the impact damper.

10. The toner bottle closure according to claim 9, wherein the force transfer element comprises, or is formed as, a lip.

11. The toner bottle closure according to claim 10, wherein the lip extends parallel to the impact damper.

12. A toner bottle closure comprising:

a first closure member configured to be fixed to a toner bottle, the first closure member having an outlet opening for dispensing toner from the toner bottle;

a second closure member attached to the first closure member and movable relative to the first closure member along an axis of movement between a closed position, in which the second closure member cooperates with the first closure member to close or seal the outlet opening, and an open position for dispensing the toner through the outlet opening; and a rotation preventer configured to prevent rotation of the second closure member around the axis of movement relative to the first closure member, wherein the rotation preventer comprises:

at least one guide, said at least one guide allowing movement of the second closure member relative to the first closure member in a direction parallel to the axis of movement, and a stop member configured to delimit an extent of axial movement of the second closure member relative to the first closure member in the open position.

13. The toner bottle closure according to claim 12, wherein the at least one guide is formed integrally with the stop member.

14. A toner bottle closure according to claim 13, wherein the at least one guide comprises a pin or peg projecting in the axial direction from the second closure member in direction towards the first closure member and at least one guide opening in the first closure member, through which the pin or peg extends.

15. A toner bottle closure according to claim 14, wherein the stop member is formed as an engagement means, especially an engagement hook, at an end region of the pin or peg for engaging a rim or edge of the guide opening.

16. A toner bottle comprising:

the toner bottle closure according to claim 1.

* * * * *